US009226344B2

(12) United States Patent
Fishman

(10) Patent No.: US 9,226,344 B2
(45) Date of Patent: Dec. 29, 2015

(54) MELTING AND MIXING OF MATERIALS IN A CRUCIBLE BY ELECTRIC INDUCTION HEEL PROCESS

(71) Applicant: Inductotherm Corp., Rancocas, NJ (US)

(72) Inventor: Oleg S. Fishman, Maple Glen, PA (US)

(73) Assignee: INDUCTOTHERM CORP., Rancocas, NJ (US)

( * ) Notice: Subject to any disclaimer, the term of this patent is extended or adjusted under 35 U.S.C. 154(b) by 249 days.

(21) Appl. No.: 14/021,574

(22) Filed: Sep. 9, 2013

(65) Prior Publication Data

US 2014/0029644 A1 Jan. 30, 2014

Related U.S. Application Data

(62) Division of application No. 12/268,846, filed on Nov. 11, 2008, now Pat. No. 8,532,158.

(60) Provisional application No. 60/988,783, filed on Nov. 17, 2007.

(51) Int. Cl.

| | |
|---|---|
| ***H05B 6/34*** | (2006.01) |
| ***H05B 6/06*** | (2006.01) |
| ***H05B 6/22*** | (2006.01) |
| ***F27B 14/06*** | (2006.01) |
| ***F27B 14/14*** | (2006.01) |
| ***F27D 99/00*** | (2010.01) |
| ***H05B 6/32*** | (2006.01) |
| ***H05B 6/36*** | (2006.01) |
| ***H05B 6/24*** | (2006.01) |
| ***H05B 6/44*** | (2006.01) |

(52) U.S. Cl.

CPC ..... *H05B 6/34* (2013.01); *F27B 14/061* (2013.01); *F27B 14/14* (2013.01); *F27D 99/0006* (2013.01); *H05B 6/067* (2013.01); *H05B 6/24* (2013.01); *H05B 6/32* (2013.01); *H05B 6/367* (2013.01); *H05B 6/44* (2013.01); *H05B 2213/02* (2013.01)

(58) Field of Classification Search

CPC ..... H05B 6/32; H05B 6/24; H05B 6/34; H05B 6/44; H05B 6/067; H05B 6/367; H05B 2213/02; F27B 14/061; F27B 14/14; F27D 99/0006

USPC ..... 373/146, 148, 156, 138, 139, 144, 150, 373/151, 152, 142, 7, 59, 147, 149; 219/671, 662, 661, 663; 266/233, 234

See application file for complete search history.

(56) References Cited

U.S. PATENT DOCUMENTS 3,396,229 A * 8/1968 Sundberg ..... 373/146
3,478,156 A * 11/1969 Segsworth ..... 373/146

(Continued)

*Primary Examiner* — Hung D Nguyen
(74) *Attorney, Agent, or Firm* — Philip O. Post

(57) ABSTRACT

Apparatus and method are provided for electric induction heating and melting of a transition material that is non-electrically conductive in the solid state and electrically conductive in the non-solid state in an electric induction heating and melting process wherein solid or semi-solid charge is periodically added to a heel of molten transition material initially placed in a refractory crucible. Induction power is sequentially supplied to a plurality of coils surrounding the exterior height of the crucible at high power level and high frequency with in-phase voltage until a crucible batch of transition material is in the crucible when the induction power is reduced in power level and frequency with voltage phase shifting to the induction coils along the height of the crucible to induce a unidirectional electromagnetic stir of the crucible batch of material.

16 Claims, 4 Drawing Sheets

(56) References Cited

U.S. PATENT DOCUMENTS 4,238,637 A * 12/1980 Bingen et al. ..... 373/146
6,819,704 B2 * 11/2004 Fishman et al. ..... 373/142
7,197,061 B1 * 3/2007 Fishman et al. ..... 373/142

* cited by examiner

MELTING AND MIXING OF MATERIALS IN A CRUCIBLE BY ELECTRIC INDUCTION HEEL PROCESS

CROSS REFERENCE TO RELATED APPLICATIONS

This is a divisional application of application Ser. No. 12/268,846, filed Nov. 11, 2008, which application claims the benefit of U.S. Provisional Application No. 60/988,783, filed Nov. 17, 2007, both of which applications are hereby incorporated herein by reference in their entireties.

FIELD OF THE INVENTION

The present invention relates to electric induction melting and mixing of materials that are in a non-electrically conductive state when gradually added to an induction refractory crucible initially holding a heel, or bottom layer, of electrically conductive molten material.

BACKGROUND OF THE INVENTION

Batch and heel are two types of electric induction processes for heating and melting of electrically conductive materials. In the batch process, a crucible is filled with a batch of electrically conductive solid charge that is melted by electric induction and then emptied from the crucible. In the heel process, a molten heel (bottom pool) of electrically conductive material is always maintained in the crucible while solid electrically conductive charge is added to the heel in the crucible and then melted by electric induction. Inductively heating and melting by the heel process when the material is non-electrically conductive in the solid state and electrically conductive in the molten state (referred to as a transition material), such as silicon, is problematic in that addition of solid non-electrically conductive charge to the molten heel must be adequately melted and mixed so that the added solid charge does not accumulate to form aggregate non-electrically conductive solid masses in, or over, the surface of the molten material.

It is one object of the present invention to provide apparatus for, and method of, heating and melting of a material that is non-electrically conductive in the solid state and electrically conductive in the molten state in a heel electric induction heating and melting process.

BRIEF SUMMARY OF THE INVENTION

In one aspect the present invention is apparatus for, and method of, electric induction heating and melting of a transition material that is non-electrically conductive in the solid state and is electrically conductive in the non-solid state in a heel electric induction heating and melting process. Multiple coils are provided around the height of the crucible, which contains a heel of molten transition material at the start of the melting process. Initially, relatively high magnitude, in-phase melting power at a relatively high frequency is sequentially supplied to each coil from one or more power supplies until the crucible is filled with transition material. When the crucible is substantially filled with transition material, the output frequency of the one or more power supplies is lowered to a stirring frequency along with the magnitude of the output power, while an out-of-phase relationship is established between the output voltages of the power supplies to achieve a preferred electromagnetic stir pattern.

The above and other aspects of the invention are set forth in this specification and the appended claims.

BRIEF DESCRIPTION OF THE DRAWINGS

The appended drawings, as briefly summarized below, are provided for exemplary understanding of the invention, and do not limit the invention as further set forth in this specification.

DETAILED DESCRIPTION OF THE INVENTION

Figure 1:
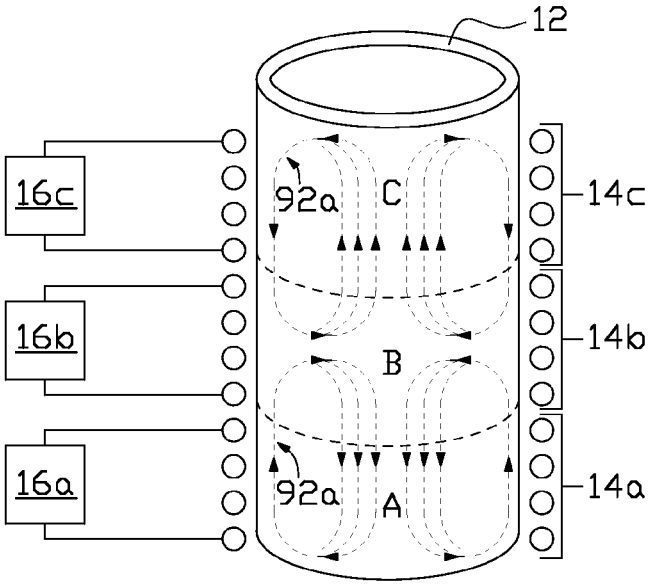
FIGS. 1 and 2(*a*) are simplified diagrams of one example of the present invention utilizing three separate induction coils (shown in cross section) wound around the exterior of a crucible, and FIG. 2(*b*) is a vector diagram illustrating phase relationships for voltage outputs of power supplies used in the example to achieve a preferred electromagnetic stir pattern.
Figure 2A:
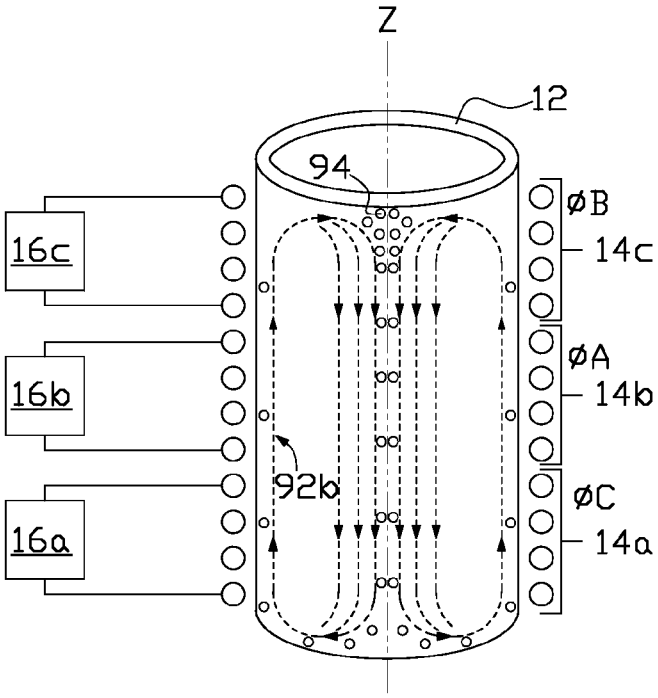
Figure 2B:
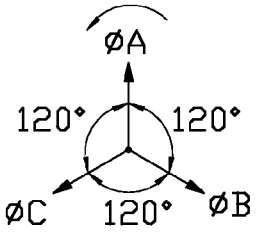

Referring to FIG. 1 and FIG. 2(*a*), in one non-limiting example of the present invention, refractory crucible 12 is exteriorly surrounded by lower volume induction coil 14*a*, central volume induction coil 14*b* and upper volume induction coil 14*c*. Interior lower volume A of the crucible is generally the interior region of the crucible surrounded by lower volume induction coil 14*a*; interior central volume B of the crucible is generally the interior region of the crucible surrounded by central volume induction coil 14*b*; and interior upper volume C of the crucible is generally the interior region of the crucible surrounded by upper volume induction coil 14*c*. The approximate boundaries of each interior volume are indicated by dashed lines in the figures. Lower volume induction coil 14*a* is disposed around at least the minimum level of operating heel of material to be generally maintained in the furnace. Separate power supplies 16*a*, 16*b* and 16*c* supply ac power to each of the lower, central and upper induction coils, respectively. Each power supply may comprise, for example, a converter/inverter that rectifies ac utility power to dc power, which dc power is converted to ac power with suitable characteristics for connection to one of the induction coils. In operation, starting with only the heel of molten transition material in the crucible, power supply 16*a* operates at a relatively high frequency, $f_1$, for example 120 Hertz in this non-limiting example, and at a relatively high power output, for example full output voltage (power) rating (normalized as 1.0), as charge is added to the crucible. Charge of solid and/or semi-solid transition material is gradually added to the heel of material in the crucible. For example, the starting heel of molten transition material may represent 20 percent of the full (100 percent) capacity of the crucible. If the transition material is silicon, added charge may be in the form of silicon granules, or other forms of metallurgical grade silicon, and the heel of molten silicon is kept at or above its melting temperature (nominally 1,450° C.) by flux coupling with the magnetic field created by current flow through induction coil 14*a*. When sufficient charge has been added to at least partially occupy central volume B of the crucible, the output of power supply 16*b* is applied to central volume induction coil 14*b* at substantially the same frequency, $f_1$, as the output of power supply 16*a*, and at substantially the same relatively high power output as that for power supply 16*a*. Voltage outputs for power supplies 16*a* and 16*b* are synchronized in-phase. The magnetic field created by current flow through induction coil 14*b* couples with silicon in the central volume of the crucible to inductively heat the silicon primarily in the central volume. When sufficient charge has been added to at least partially occupy upper volume C of the crucible, the output of power supply 16*c* is applied to upper volume induction coil 14*c* at substantially the same frequency, $f_1$, as the outputs of power supplies 16*a* and 16*b*, and at substantially the same relatively high power output as that for power supplies 16*a* and 16*b*, with the voltage outputs of the three power supplies operating in-phase. The magnetic field created by current flow through induction coil 14*c* couples with silicon in the upper volume of the crucible to inductively heat the silicon primarily in the upper volume. The above operating conditions for this non-limiting example of the invention are summarized in the following table:

| | output frequency | output power magnitude (normalized) | phase relationships of output voltages |
|---|---|---|---|
| power supply 16a | $f_1$ | 1.0 | in-phase |
| power supply 16b | $f_1$ | 1.0 | in-phase |
| power supply 16c | $f_1$ | 1.0 | in-phase |

With the operating conditions identified in the above table, the induced electromagnetic stir pattern can be represented by exemplary flow lines 92*a* (shown in dashed lines) in FIG. 1, which is a double vortex ring, or toroidal vortex, flow pattern with separate vortex rings in the lower and upper halves of the crucible.

After the crucible is substantially filled with solid and/or semi-solid charge of transition material to a level that includes at least a part of upper crucible volume C, the output frequency of all three power supplies can be lowered to the same frequency, which is lower than $f_1$, for example, $f_2=0.5f_1$ (60 Hertz in this non-limiting example) with all three power supplies operating at a reduced voltage (power) output, for example 0.5 normalized power output, with 120 degrees out-of-phase voltage orientations as illustrated by the vector diagram in FIG. 2(*b*). The above operating conditions for this non-limiting example of the invention are summarized in the following table:

| | output frequency | output power magnitude (normalized) | phase relationships of output voltages |
|---|---|---|---|
| power supply 16a | $0.5f_1$ | 0.5 | 120 degrees phase shift |
| power supply 16b | $0.5f_1$ | 0.5 | 120 degrees phase shift |
| power supply 16c | $0.5f_1$ | 0.5 | 120 degrees phase shift |

With the operating conditions identified in the above table, the induced electromagnetic stir pattern can be represented by exemplary flow lines 92*b* (shown in dashed lines) in FIG. 2(*a*) to create a single vortex ring flow pattern in the crucible with a downward flow pattern about the poloidal (circular) axis Z of the ring, or counterclockwise poloidal rotation. With this flow pattern, remaining solid or semi-solid transition material from the charge in the crucible will be drawn downwards around the poloidal axis of the ring in the central vertical region of the interior of the crucible and upwards along the inner walls of the crucible to rapidly melt any of the remaining solid or semi-solid transition material 94 from the charge added to the heel of material in the crucible. The poloidal rotation may be reversed to clockwise by reversing the phase rotation of the power supplies; that is, the A-C-B phase rotation for counterclockwise poloidal rotation can be changed to A-B-C phase rotation for clockwise poloidal rotation. In some examples of the invention, alternating or jogging back and forth between the counterclockwise and clockwise directions may be preferable for at least some of the stirring time period to assist in melting and stirring of the added charge.

After melting all added transition charge material, molten transition material may be extracted from the crucible by any suitable extraction process, such as, but not limited to, bottom pour through a reclosable tap in the crucible, tilt pour by suitable crucible tilting apparatus, or pressure pour by enclosing the crucible and forcing molten material from the crucible out of a passage by applying positive pressure to the volume of molten material in the crucible, while leaving a required heel of molten transition material in the crucible to be used at the start of the next charge melting process.

Alternatively the molten transition material may be directionally solidified in the crucible by removing power sequentially from the lower, central and upper volume induction coils so that the mass of molten silicon in the crucible solidifies from bottom to top.

Figure 7:
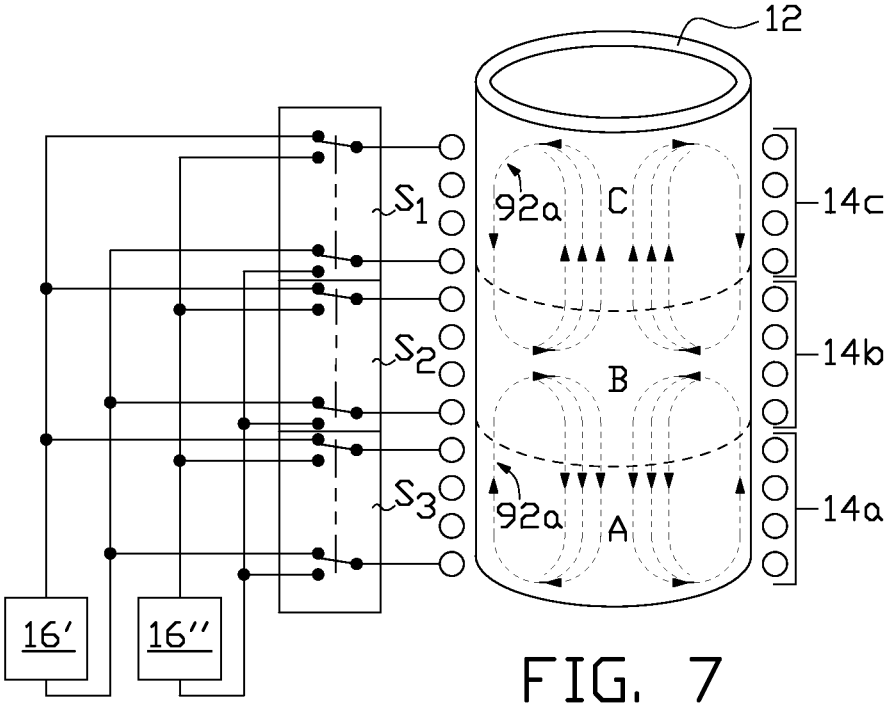
FIG. 7 and FIG. 8 are simplified diagrams of another example of the present invention utilizing three separate induction coils (shown in cross section) wound around the exterior of a crucible.
Figure 8:
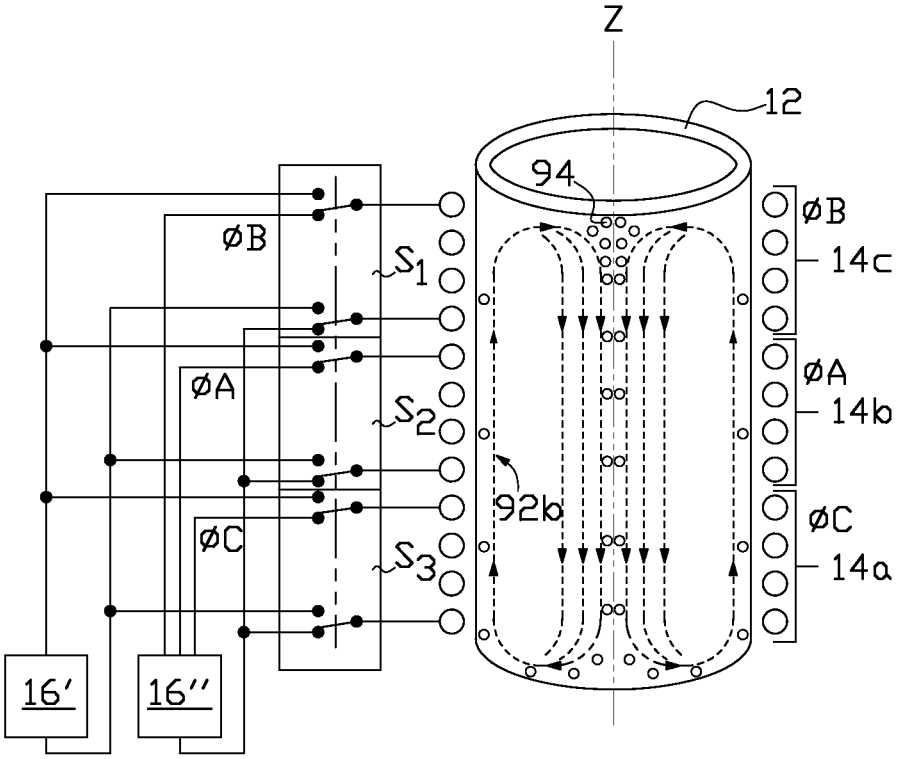

By way of example and not limitation, in some examples of the invention, power supplies 16*a*, 16*b* and 16*c* may operate alternatively only: either with fixed output frequency $f_1$, high output voltage (power) magnitude and phase synchronized for melting of transition material; or with fixed output frequency $f_2$, low output voltage (power) magnitude and 120 degrees shift between phases for stirring of transition material. In other examples of the invention, the three power supplies may be replaced with a single three phase power supply with 120 degrees shift between phases and connection of each phase to one of the three coils for stirring. For the above example, since the stir frequency $f_2$, is in the range of nominal utility frequency (50 to 60 Hertz), the stir power supply may be derived from a utility source with phase shifting, if required. A suitable switching arrangement may be provided for switching the outputs of the single three phase supply with a source of in-phase power to the three induction coils to transition from primarily stirring to melting. For example in FIG. 7 during the process step when charge is being added to the crucible, all three induction coils can be connected to the common single phase output of single high power, high frequency output power supply 16' via switches $S_1$, $S_2$ and $S_3$. After a crucible batch of transition material has been added to the crucible, the positions of switches $S_1$, $S_2$ and $S_3$ can be changed so that the three induction coils are connected to a three phase utility power source 16" as shown in FIG. 8. In other examples of the invention, the power supplies may be arranged to alternate between the melting and stirring states.

Figure 3:
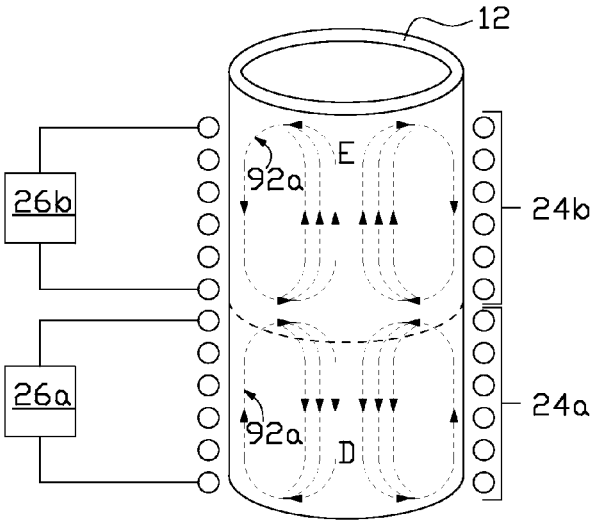
FIGS. 3 and 4(*a*) are simplified diagrams of another example of the present invention utilizing two separate induction coils (shown in cross section) wound around the exterior of a crucible, and FIG. 4(*b*) is a vector diagram illustrating phase relationships for voltage outputs of power supplies used in the example to achieve a preferred electromagnetic stir pattern.
Figure 4A:
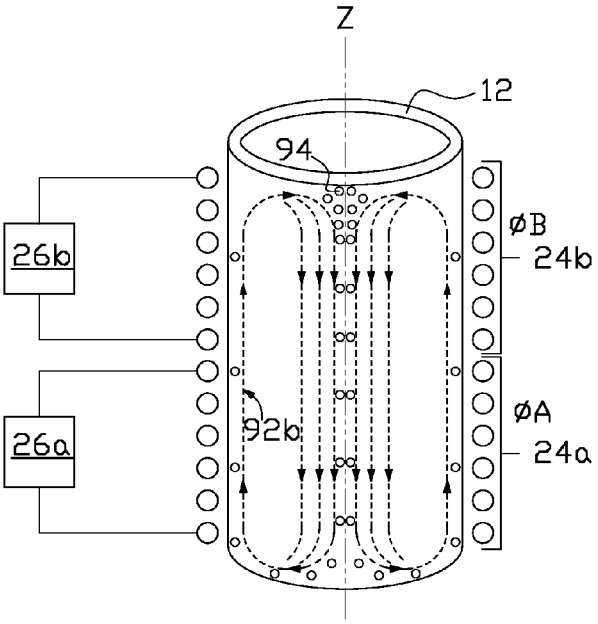
Figure 4B:
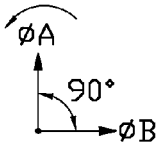

In another example of the present invention, referring to FIG. 3 and FIG. 4(*a*), refractory crucible 12 is exteriorly surrounded by lower volume induction coil 24*a* and upper volume induction coil 24*b*. Interior lower volume D of the crucible is generally the interior region of the crucible surrounded by lower volume induction coil 24*a*, and interior upper volume E of the crucible is generally the interior region of the crucible surrounded by upper volume induction coil 24*b*. The approximate boundaries of each interior volume are indicated by dashed lines in the figures. Lower volume induction coil 24*a* is disposed around at least the minimum level of operating heel of material to be generally maintained in the furnace. Separate power supplies 26*a* and 26*b* supply ac power to each of the lower and upper induction coils, respectively. Each power supply may comprise, for example, a converter/inverter that rectifies ac utility power to dc power, which dc power is converted to ac power with suitable characteristics for connection to one of the induction coils. In operation, starting with only the heel of molten transition material in the crucible, power supply 26*a* operates at a relatively high frequency, $f_1$, for example 120 Hertz in this non-limiting example, and at a relatively high power output, for example full output voltage (power) rating (normalized as 1.0), as charge is added to the crucible. Charge of solid and/or semi-solid transition material is gradually added to the heel of material in the crucible. For example, the starting heel of molten transition material may represent 20 percent of the full (100 percent) capacity of the crucible. If the transition material is silicon, added charge may be in the form of silicon granules, or other forms of metallurgical grade silicon, and the heel of molten silicon is kept at or above its melting temperature (nominally 1,450° C.) by flux coupling with the magnetic field created by current flow through induction coil 24*a*. When sufficient charge has been added to at least partially occupy upper volume E of the crucible, the output of power supply 26*b* is applied to upper volume induction coil 24*b* at substantially the same frequency, $f_1$, as the output of power supply 26*a*, and at substantially the same relatively high power output as that for power supply 26*a*. Voltage outputs for power supplies 26*a* and 26*b* are synchronized in-phase. The magnetic field created by current flow through induction coil 24*b* couples with silicon in the upper volume of the crucible to heat the silicon primarily in the upper zone. The above operating conditions for this non-limiting example of the invention are summarized in the following table:

| | output frequency | output power magnitude (normalized) | phase relationships of output voltages |
|---|---|---|---|
| power supply 26a | $f_1$ | 1.0 | in-phase |
| power supply 26b | $f_1$ | 1.0 | in-phase |

With the operating conditions identified in the above table, the induced electromagnetic stir pattern can be represented by exemplary flow lines 92*a* (shown in dashed lines) in FIG. 3, which is a double vortex ring flow pattern with separate vortex rings in the lower and upper halves of the crucible.

After the crucible is filled with solid and/or semi-solid charge of transition material to a level that includes at least a part of upper crucible volume E, the output frequency of both power supplies can be lowered to the same frequency, which is lower than $f_1$, for example, $f_2=0.5f_1$ (60 Hertz in this non-limiting example) with both power supplies operating at a reduced voltage (power) output, for example 0.5 normalized power output, with 90 degrees out-of-phase voltage orientations as illustrated by the vector diagram in FIG. 4(*b*). The above operating conditions for this non-limiting example of the invention are summarized in the following table:

| | output frequency | output power magnitude (normalized) | phase relationships of output voltages |
|---|---|---|---|
| power supply 26a | $0.5f_1$ | 0.5 | 90 degrees phase shift |
| power supply 26b | $0.5f_1$ | 0.5 | 90 degrees phase shift |

With the operating conditions identified in the above table, the induced electromagnetic stir pattern can be represented by exemplary flow lines 92*b* (shown in dashed lines) in FIG. 4(*a*) to create a single vortex ring flow pattern in the crucible with a downward flow pattern about the poloidal (circular) axis Z of the ring, or counterclockwise poloidal rotation. With this flow pattern, remaining solid or semi-solid transition material from the charge in the crucible will be drawn downwards around the poloidal axis of the ring in the central vertical region of the interior of the crucible and upwards along the inner walls of the crucible to rapidly melt any of the remaining solid or semi-solid transition material 94 from the charge added to the heel in the crucible. The poloidal rotation may be reversed to clockwise by reversing the phase rotation of the power supplies; that is, the B-A phase rotation for counterclockwise poloidal rotation can be changed to A-B phase rotation for clockwise poloidal rotation. In some examples of the invention, alternating or jogging back and forth between the counterclockwise and clockwise directions may be preferable for at least some of the stirring time period to assist in melting and stirring of the added charge.

After melting all added transition charge material, molten transition material may be extracted from the crucible by any suitable extraction process, such as, but not limited to, bottom pour through a reclosable tap in the crucible, tilt pour by suitable crucible tilting apparatus, or pressure pour by enclosing the crucible and forcing molten material from the crucible out of a passage by applying positive pressure to the volume of molten material in the crucible, while leaving a required heel of molten transition material in the crucible to be used at the start of the next charge melting process.

Alternatively the molten transition material may be directionally solidified in the crucible by removing power sequentially from the lower and upper volume induction coils so that the mass of molten silicon in the crucible solidifies from bottom to top.

By way of example and not limitation, in some examples of the invention, power supplies 26*a* and 26*b* may operate alternatively only: either with fixed output frequency $f_1$, high output voltage (power) magnitude and phase synchronized for melting of transition material; or with fixed output frequency $f_2$, low output voltage (power) magnitude and 90 degrees shift between phases for stirring of transition material. In other examples of the invention, the two power supplies may be replaced with a single two phase power supply with 90 degrees shift between phases and connection of each phase to one of the two coils for stirring. For the above example, since the stir frequency $f_2$, is utility frequency, 60 Hertz, the stir power supply may be derived from a utility source with phase shifting, if required. A suitable switching arrangement may be provided for switching the outputs of the single two phase supply with a source of in-phase power to the two induction coils to transition from primarily stirring to melting. In other examples of the invention, the power supplies may be arranged to alternate between the melting and stirring states.

Figure 5:
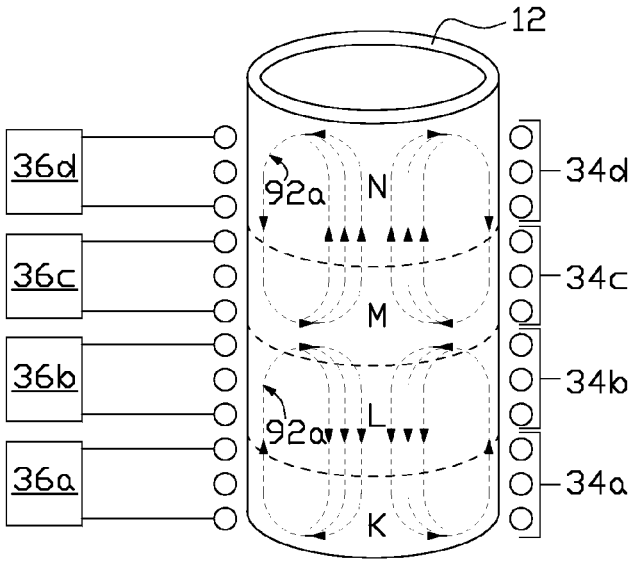
FIGS. 5 and 6(*a*) are simplified diagrams of another example of the present invention utilizing four separate induction coils (shown in cross section) wound around the exterior of a crucible, and FIG. 6(*b*) is a vector diagram illustrating phase relationships for voltage outputs of power supplies used in the example to achieve a preferred electromagnetic stir pattern.
Figure 6A:
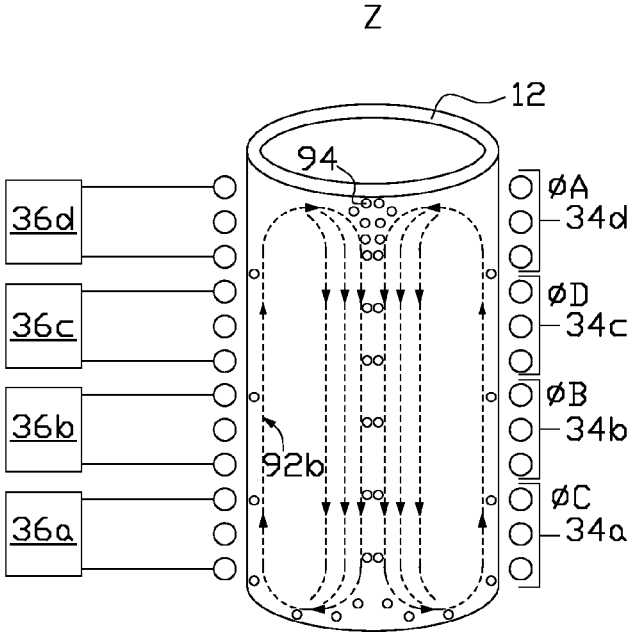
Figure 6B:
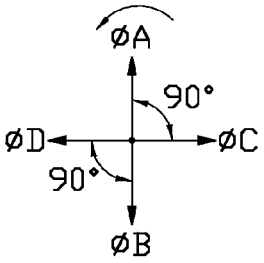

In another example of the present invention, referring to FIG. 5 and FIG. 6(*a*), refractory crucible 12 is exteriorly surrounded by first quadrant volume induction coil 34*a*; second quadrant volume induction coil 34*b*, third quadrant volume induction coil 34*c*; and fourth quadrant volume induction coil 34*d*. Interior first quadrant volume K of the crucible is generally the interior region of the crucible surrounded by first quadrant volume induction coil 34*a*; interior second quadrant volume L of the crucible is generally the interior region of the crucible surrounded by second quadrant volume induction coil 34*b*; interior third quadrant volume M of the crucible is generally the interior region of the crucible surrounded by third quadrant volume induction coil 34*c*; and interior fourth quadrant volume N of the crucible is generally the interior region of the crucible surrounded by fourth quadrant volume induction coil 34*d*. The approximate boundaries of each interior volume are indicated by dashed lines in the figures. First quadrant volume induction coil 34*a* is disposed around at least the minimum level of operating heel to be generally maintained in the furnace. Power supplies 36*a*, 36*b*, 36*c* and 36*d* supply ac power to the first, second, third and fourth quadrant induction coils, respectively. Each power supply may comprise, for example, a converter/inverter that rectifies ac utility power to dc power, which dc power is converted to ac power with suitable characteristics for connection to one of the induction coils. In operation, starting with only the heel of molten transition material in the crucible, power supply 36*a* operates at a relatively high frequency, $f_1$, for example 120 Hertz in this non-limiting example, and at a relatively high power output, for example full output voltage (power) rating (normalized as 1.0), as charge is added to the crucible. Charge of solid and/or semi-solid transition material is gradually added to the heel of material in the crucible. For example, the starting heel of molten transition material may represent 20 percent of the full (100 percent) capacity of the crucible. If the transition material is silicon, added charge may be in the form of silicon granules, or other forms of metallurgical grade silicon, and the heel of molten silicon is kept at or above its melting temperature (nominally 1,450° C.) by flux coupling with the magnetic field created by current flow through induction coil 34*a*. When sufficient charge has been added to at least partially occupy second quadrant volume L of the crucible, the output of power supply 36*b* is applied to second quadrant volume induction coil 34*b* at substantially the same frequency, $f_1$, as the output of power supply 36*a*, and at substantially the same relatively high power output as that for power supply 36*a*. Voltage outputs for power supplies 36*a* and 36*b* are synchronized in-phase. The magnetic field created by current flow through induction coil 34*b* couples with silicon in the second quadrant volume of the crucible to inductively heat the silicon primarily in the second quadrant volume. When sufficient charge has been added to at least partially occupy third quadrant volume M of the crucible, the output of power supply 36*c* is applied to third quadrant volume induction coil 34*c* at substantially the same frequency, $f_1$, as the outputs of power supplies 36*a* and 36*b*, and at substantially the same relatively high power output as that for power supplies 36*a* and 36*b*, with the voltage outputs of the three power supplies operating in-phase. The magnetic field created by current flow through induction coil 34*c* couples with silicon in the third quadrant volume of the crucible to inductively heat the silicon primarily in the third quadrant volume. When sufficient charge has been added to at least partially occupy fourth quadrant volume N of the crucible, the output of power supply 36*d* is applied to fourth quadrant volume induction coil 34*d* at substantially the same frequency, $f_1$, as the outputs of power supplies 36*a*, 36*b* and 36*c*, and at substantially the same relatively high power output as that for power supplies 36*a*, 36*b* and 36*c*, with the voltage outputs of the four power supplies operating in-phase. The magnetic field created by current flow through induction coil 34*d* couples in the fourth quadrant volume of the crucible to inductively heat the silicon primarily in the fourth quadrant volume. The above operating conditions for this non-limiting example of the invention are summarized in the following table:

| | output frequency | output power magnitude (normalized) | phase relationships of output voltages |
|---|---|---|---|
| power supply 36a | $f_1$ | 1.0 | in-phase |
| power supply 36b | $f_1$ | 1.0 | in-phase |
| power supply 36c | $f_1$ | 1.0 | in-phase |
| power supply 36d | $f_1$ | 1.0 | in-phase |

With the operating conditions identified in the above table, the induced electromagnetic stir pattern can be represented by exemplary flow lines 92*a* (shown in dashed lines) in FIG. 5, which is a double vortex ring, or toroidal vortex, flow pattern with separate vortex rings in the lower and upper halves of the crucible.

After the crucible is filled with solid and/or semi-solid charge of transition material to a level that includes at least a part of fourth quadrant crucible volume N, the output frequency of all four power supplies can be lowered to the same relatively low frequency, for example, $f_2=0.5f_1$ (60 Hertz in this non-limiting example) with all four power supplies operating at a reduced voltage (power) output, for example 0.5 normalized power output, with 90 degrees out-of-phase voltage orientations as illustrated by the vector diagram in FIG. 6(*b*). The above operating conditions for this non-limiting example of the invention are summarized in the following table:

| | output frequency | output power magnitude (normalized) | phase relationships of output voltages |
|---|---|---|---|
| power supply 36a | $0.5f_1$ | 0.5 | 90 degrees phase shift |
| power supply 36b | $0.5f_1$ | 0.5 | 90 degrees phase shift |
| power supply 36c | $0.5f_1$ | 0.5 | 90 degrees phase shift |
| power supply 36d | $0.5f_1$ | 0.5 | 90 degrees phase shift |

With the operating conditions identified in the above table, the induced electromagnetic stir pattern can be represented by exemplary flow lines 92*b* (shown in dashed lines) in FIG. 6(*a*) to create a single vortex ring flow pattern in the crucible with a downward flow pattern about the poloidal (circular) axis Z of the ring, or counterclockwise poloidal rotation. With this flow pattern, remaining solid or semi-solid transition material from the charge in the crucible will be drawn downwards around the poloidal axis of the ring in the central vertical region of the interior of the crucible and upwards along the inner walls of the crucible to rapidly melt any of the remaining solid or semi-solid transition material 94 from the charge added to the heel in the crucible. The poloidal rotation may be reversed to clockwise by reversing the phase rotation of the power supplies; that is, the A-D-B-C phase rotation for counterclockwise poloidal rotation can be changed to A-C-B-D phase rotation for clockwise poloidal rotation. In some examples of the invention, alternating or jogging back and forth between the counterclockwise and clockwise directions may be preferable for at least some of the stirring time period to assist in melting and stirring of added charge.

After melting all added transition charge material, molten transition material may be extracted from the crucible by any suitable extraction process, such as, but not limited to, bottom pour through a reclosable tap in the crucible, tilt pour by suitable crucible tilting apparatus, or pressure pour by enclosing the crucible and forcing molten material from the crucible out of a passage by applying positive pressure to the volume of molten material in the crucible, while leaving a required heel of molten transition material in the crucible to be used at the start of the next charge melting process.

Alternatively the molten transition material may be directionally solidified in the crucible by removing power sequentially from the first quadrant, second quadrant, third quadrant and fourth quadrant volume induction coils so that the mass of molten silicon in the crucible solidifies from bottom to top.

By way of example and not limitation, in some examples of the invention, power supplies 36*a*, 36*b*, 36*c* and 36*c* may operate alternatively only: either with fixed output frequency $f_1$, high output voltage (power) magnitude and phase synchronized for melting of transition material; or with fixed output frequency $f_2$, low output voltage (power) magnitude and 90 degrees shift between phases for stirring of transition material. In other examples of the invention, the four power supplies may be replaced with a single four phase power supply with 90 degrees shift between phases and connection of each phase to one of the four coils for stirring. For the above example, since the stir frequency $f_2$, is utility frequency, 60 Hertz, the stir power supply may be derived from a utility source with phase shifting, if required. A suitable switching arrangement may be provided for switching the outputs of the single four phase supply with a source of in-phase power to the four induction coils to transition from primarily stirring to melting. In other examples of the invention, the power supplies may be arranged to alternate between the melting and stirring states.

While the above examples of the invention comprise a specific number of induction coils and power supplies, other quantities of induction coils and power supplies may be used in the invention with suitable modification to particular arrangements. While each of the induction coils surrounds an equal portion of the refractory crucible, in other examples of the invention, the portions of the refractory crucible surrounded by each coil may be unequal so that each current flow in each coil may generate a magnetic field that couples with non-solid transition material in unequal interior volumes of the crucible.

The above examples of the invention have been provided for the purpose of explanation and are not limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification and the appended claims, may effect numerous modifications thereto, and changes may be made without departing from the scope of the invention in its aspects.

The invention claimed is:

1. A method of melting a crucible batch of a transition material by gradually adding a solid or semi-solid charge of the transition material to a molten heel of the transition material in a crucible having a plurality of induction coils surrounding the exterior of the crucible, each one of the plurality of induction coils exclusively surrounding one of a plurality of partial interior volumes forming a total interior volume of the crucible, the lowest one of the plurality of partial interior volumes comprising a bottom interior volume and the highest one of the plurality of partial interior volumes comprising a top interior volume of the crucible, the method comprising the steps of:

loading the molten heel of the transition material into at least a portion of the bottom interior volume;

connecting a bottom volume output of a melting power source to the one of the plurality of induction coils surrounding the bottom interior volume, the bottom volume output of the melting power source operating at a melting frequency and a melting power level to keep the molten heel of the transition material at least at the minimum melting temperature of the transition material;

sequentially adding the solid or semi-solid charge of the transition material into at least a part of each of the next highest one of the plurality of partial interior volumes up to the top interior volume and connecting a discrete next highest volume output of the melting power source to the one of the plurality of induction coils surrounding the next highest one of the plurality of partial interior volumes to which the solid or semi-solid charge of the transition material is added and a top volume output of the melting power source to the one of the plurality of induction coils surrounding the top interior volume until the crucible is filled to the total interior volume of the crucible with the crucible batch of the transition material, the discrete next highest volume outputs of the melting power source and the top volume output of the melting power source operating at the melting frequency and the melting power level; and simultaneously disconnecting the top volume output of the melting power source, the discrete next highest volume outputs of the melting power source and the bottom output volume of the melting power source from the plurality of induction coils and connecting a discrete one of a plurality of stir outputs of at least one stirring power source to each one of the plurality of induction coils, the plurality of stir outputs of the at least one stirring power source operating at a stirring frequency and a stirring power level, the stirring frequency being lower than the melting frequency, and the stirring power level being lower than the melting power level, the output stir voltage of each of the plurality of stir outputs of the at least one stirring power source phase shifted from each other to induce an unidirectional electromagnetic stirring of the crucible batch of the transition material in the crucible.

2. The method of claim 1 wherein the at least one stirring power source is a utility power source operating in the range of 50 to 60 Hertz.

3. The method of claim 2 wherein the utility power source is phase shifted.

4. The method of claim 1 wherein a direction of rotation of the phase shifted output stir voltage of each of the plurality of stir outputs of the at least one stirring power source is repeatedly reversed so that the unidirectional electromagnetic stirring alternates between reversed flow directions of the crucible batch of the transition material in the crucible.

5. The method of claim 1 further comprising the step of sequentially removing the output of the melting power source or the at least one stirring power source from each one of the plurality of induction coils from the bottom interior volume to the top interior volume of the crucible to directionally solidify the crucible batch of the transition material in the crucible.

6. The method of claim 1 wherein the stirring frequency is one-half of the melting frequency and/or the stirring power is one-half the melting power.

7. The method of claim 1 wherein the output stir voltage of each of the plurality of stir outputs of the at least one stirring power source is sequentially phase shifted 120 degrees with counterclockwise-rotation or clockwise-rotation.

8. The method of claim 1 further comprising the step of alternating between the steps of connecting the bottom volume output, the discrete next highest volume outputs and the top volume out of the melting power source and connecting the plurality of stir outputs of the at least one stirring power source to the plurality of induction coils.

9. A method of melting a crucible batch of a transition material by gradually adding a solid or semi-solid charge of the transition material to a molten heel of the transition material in a crucible having a lower induction coil exteriorly surrounding a bottom interior volume of the crucible, a mid induction coil exteriorly surrounding a middle interior volume of the crucible, and an upper induction coil exteriorly surrounding a top interior volume of the crucible, the lower, mid and upper induction coils respectively connected to first, second and third outputs of a melting power source, the method comprising the steps of:

loading the molten heel of the transition material into at least a bottom portion of the bottom interior volume of the crucible and operating the first output of the melting power source at a melting frequency and a melting power level to keep the molten heel of the transition material at least at the minimum melting temperature of the transition material;

simultaneously adding the solid or semi-solid charge of the transition material into at least a mid portion of the middle interior volume of the crucible and operating the second output of the melting power source at the melting frequency and the melting power level while synchronizing the phase of the output voltage of the second output of the melting power source with the phase of the output voltage of the first output of the melting power source;

simultaneously adding the solid or semi-solid charge of the transition material into at least a top portion of the top interior volume of the crucible to form the crucible batch of the transition material and operating the third output of the melting power source at the melting frequency and the melting power level while synchronizing the phase of the output voltage of the third output of the melting power source with the phase of the output voltages of the first and second outputs of the melting power source; and simultaneously disconnecting the first, second and third outputs of the melting power source from the lower, mid and upper induction coils and respectively connecting a first, second and third stir outputs from at least one stirring power source to the lower, mid and upper induction coils, the at least one stirring power source operating at a stirring frequency and a stirring power level, the stirring frequency being lower than the melting frequency, and the stirring power level being lower than the melting power level, the output stir voltage of each of the first, second and third stir outputs of the at least one stirring power source sequentially phase shifted from each other to induce an unidirectional electromagnetic stirring of the crucible batch of the transition material in the crucible.

10. The method of claim 9 wherein the at least one stirring power source is a utility power source operating in the range of 50 to 60 Hertz.

11. The method of claim 10 wherein the utility power source is phase shifted.

12. The method of claim 9 wherein a direction of rotation of the phase shifted output stir voltage of each of the plurality of stir outputs of the at least one stirring power source is repeatedly reversed so that the unidirectional electromagnetic stirring alternates between reversed flow directions of the crucible batch of the transition material in the crucible.

13. The method of claim 9 further comprising the step of sequentially removing the output of the melting power source or the at least one stirring power source from each one of the plurality of induction coils from the bottom interior volume to the top interior volume of the crucible to directionally solidify the crucible batch of the transition material in the crucible.

14. The method of claim 9 wherein the stirring frequency is one-half of the melting frequency and/or the stirring power is one-half the melting power.

15. The method of claim 9 wherein the output stir voltage of each of the first, second and third stir outputs of the at least one stirring power source is sequentially phase shifted 120 degrees with counterclockwise-rotation or clockwise-rotation.

16. The method of claim 9 further comprising the step of alternating between the steps of connecting the bottom volume output, the discrete next highest volume outputs and the top volume out of the melting power source and connecting the plurality of stir outputs of the at least one stirring power source to the plurality of induction coils.

* * * * *